US006976716B2

(12) United States Patent
Lin

(10) Patent No.: US 6,976,716 B2
(45) Date of Patent: Dec. 20, 2005

(54) PORTABLE DOOR LOCK

(76) Inventor: Jui-Chin Lin, No.4,Lane 390,Jhongshan Rd., Shalu Township., Taichung Hsien (TW)

( * ) Notice: Subject to any disclaimer, the term of this patent is extended or adjusted under 35 U.S.C. 154(b) by 0 days.

(21) Appl. No.: 10/722,528

(22) Filed: Nov. 28, 2003

(65) Prior Publication Data

US 2005/0116479 A1 Jun. 2, 2005

(51) Int. Cl.[7] ..... E05C 19/18

(52) U.S. Cl. ..... 292/288; 292/289; 292/296; 292/298; 70/416

(58) Field of Search ..... 70/416; 292/289, 292/290, 297, 298, 296, 288

(56) References Cited

U.S. PATENT DOCUMENTS 3,971,100 A * 7/1976 Anop ..... 16/375
4,399,672 A * 8/1983 Moorhouse ..... 70/101
4,627,651 A * 12/1986 Grimbly ..... 292/288
5,325,685 A * 7/1994 Frank ..... 70/14
5,361,539 A * 11/1994 Widener ..... 49/394
5,515,704 A * 5/1996 van Nguyen ..... 70/416
5,566,993 A * 10/1996 Olivas ..... 292/288
5,836,626 A * 11/1998 Coy ..... 292/292
6,327,878 B1 * 12/2001 Levenson ..... 70/14
6,416,089 B1 * 7/2002 Williams, Jr. ..... 292/288

* cited by examiner

*Primary Examiner*—John B. Walsh
(74) *Attorney, Agent, or Firm*—Rosenberg, Klein & Lee

(57) ABSTRACT

A portable door lock includes a stop member and a connection plate, wherein the stop member has a slot defined therethrough and a rod is movably engaged with the slot. The stop member has two flat sides and one of which is to be contact an inside of a door. The connection plate has a hole and a tongue splits from the hole so as to be inserted in a recess in a door jamb. Two positioning holes are defined through the connection plate so that the connection plate cab be fixed to the door jamb. At least one engaging hole is defined through the connection plate so that the rod is engaged with the at least one engaging hole. A chain is connected between the stop member and the connection plate. The connection plate does not disengage from the doorjamb when the door is opened.

7 Claims, 12 Drawing Sheets

PORTABLE DOOR LOCK

FIELD OF THE INVENTION

The present invention relates to a portable door lock having a connection plate inserted between the door and the door jamb, and a stop member which is connected to the connection plate so as to preclude opening of the door.

BACKGROUND OF THE INVENTION

A conventional portable door lock is shown in FIG. 10 and generally includes a connection plate 7 that has a hole 711 defined in one end 71 thereof and a tongue 712 split from the hole 711. The connection plate 7 is inserted between a door and a doorjamb and the tongue 712 is inserted in a recess defined in the jamb. A stop member 6 has a holding hole 61 in one end and a triangle shaped portion 62 on the other end, the triangle shaped portion 62 includes two inclined flanges 621 and a slot 622 is defined through the stop member 6. The slot 622 has tow serrated insides 623 so that a rod 63 is engaged with the slot 622 with the serrated insides 623 engaged with a groove 632 defined in an outer periphery of the rod 63. A connection hole 624 is defined in a peak of the triangle shaped portion 62 and a rope or a chain 8 is connected between the connection hole 624 and an other connection hole 731 defined in the other end 73 of the connection plate 7. The rod 63 is inserted in one of four holes 721 defined in a mediate portion 72 of the connection plate 7 and one of the two inclined flanges 621 is matched with an inside of the door so that the door cannot be opened except that the rod 63 is removed from the hole 721. Nevertheless, the door lock is disengaged from the door jamb whenever the door is opened and the user has to install the door lock again. Besides, the user has to carefully install the door lock by cooperation of two hands to prevent injury when closing the door.

The present invention intends to provide a portable door lock wherein the connection plate includes two parts and the stop member is pivotably connected to one of the two parts. The stop member can be pulled to remove from the door while still being connected to the part which is pivoted to be parallel to the door when not in use.

SUMMARY OF THE INVENTION

The present invention relates to a portable door lock which comprises a stop member having a slot defined therethrough and a rod is movably engaged with the slot. The stop member has a flat side so as to contact an inside of a door. A connection plate has a hole defined through a first end thereof and a tongue splits from the hole so as to be inserted in a recess in a door jamb. Two positioning holes are defined through the first end of the connection plate so as to fix the connection plate to the jamb by two bolts. At least one engaging hole is defined through the connection plate and close to a second end of the connection plate. A chain is connected between the stop member and the connection plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
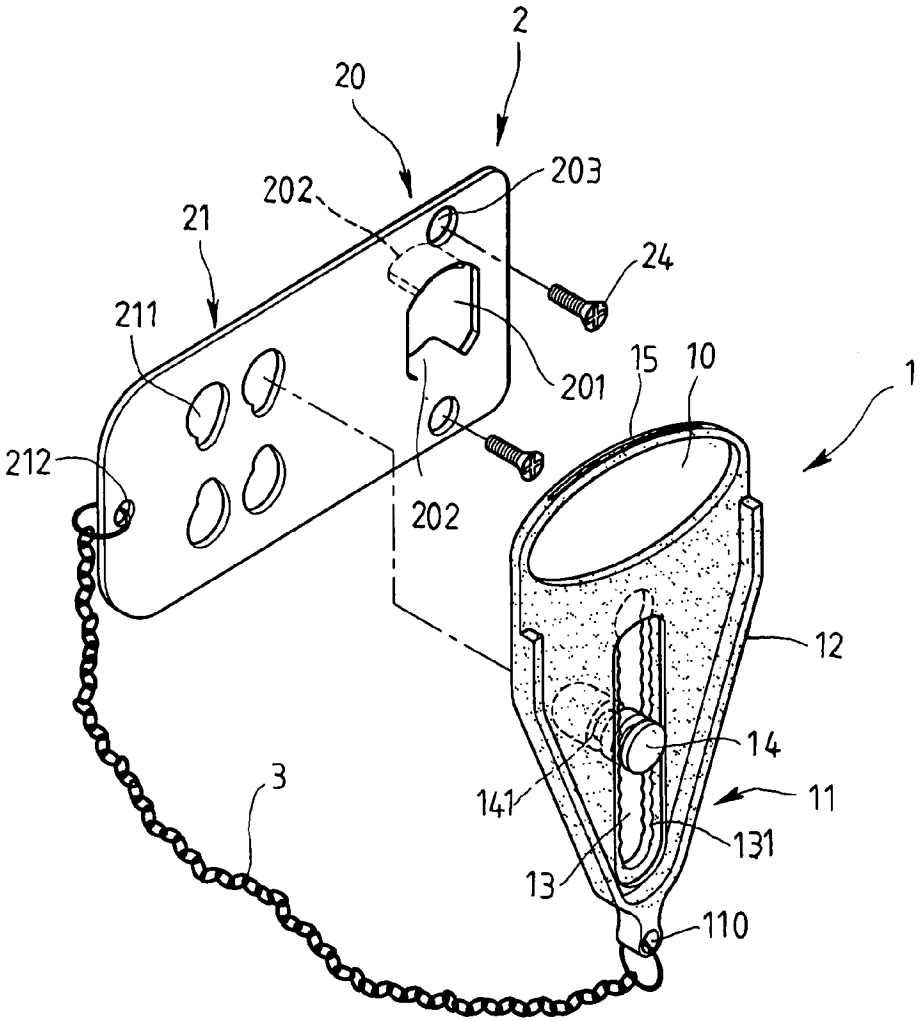
FIG. 1 is an exploded view to show the portable lock of the present invention.

Referring to FIG. 1, the portable door lock of the present invention comprises a stop member 1 having a slot 13 defined therethrough and the slot 13 includes two serrated insides 131. A rod 14 is movably engaged with the slot 13 and includes two grooves 141 defined in an outer periphery thereof. The serrated insides 131 of the slot 13 are engaged with one of the two grooves 141. The stop member 1 includes a triangle-shaped portion 11 and includes two flanges 12 extending from two sides of the triangle-shaped portion 11 so as to form two flat sides. A holding hole 10 is defined in an end of the stop member 1 and located in opposite to the triangle-shaped portion 1 such that the user may conveniently hold the stop member 1. A connection hole 110 is defined in an extension on a peak portion of the triangle-shaped portion 1.

A connection plate 2 is a flat and elongate board and has a hole 201 defined through a first end 20 thereof and two tongues 202 split from the hole 201 so as to be inserted in a recess in a door jamb (not shown). Two positioning holes 203 are defined through the first end of the connection plate 2 and two bolts 24 extend through the two positioning holes 203 so as to fix the connection plate 2 to the door jamb. Four engaging holes 211 are defined through the connection plate 2 close to a second end 21 of the connection plate 2 and a chain 3 is connected between the connection hole 110 of the stop member 1 and another connection hole 212 defined in the second end 21 of the connection plate 2.

Figure 5:
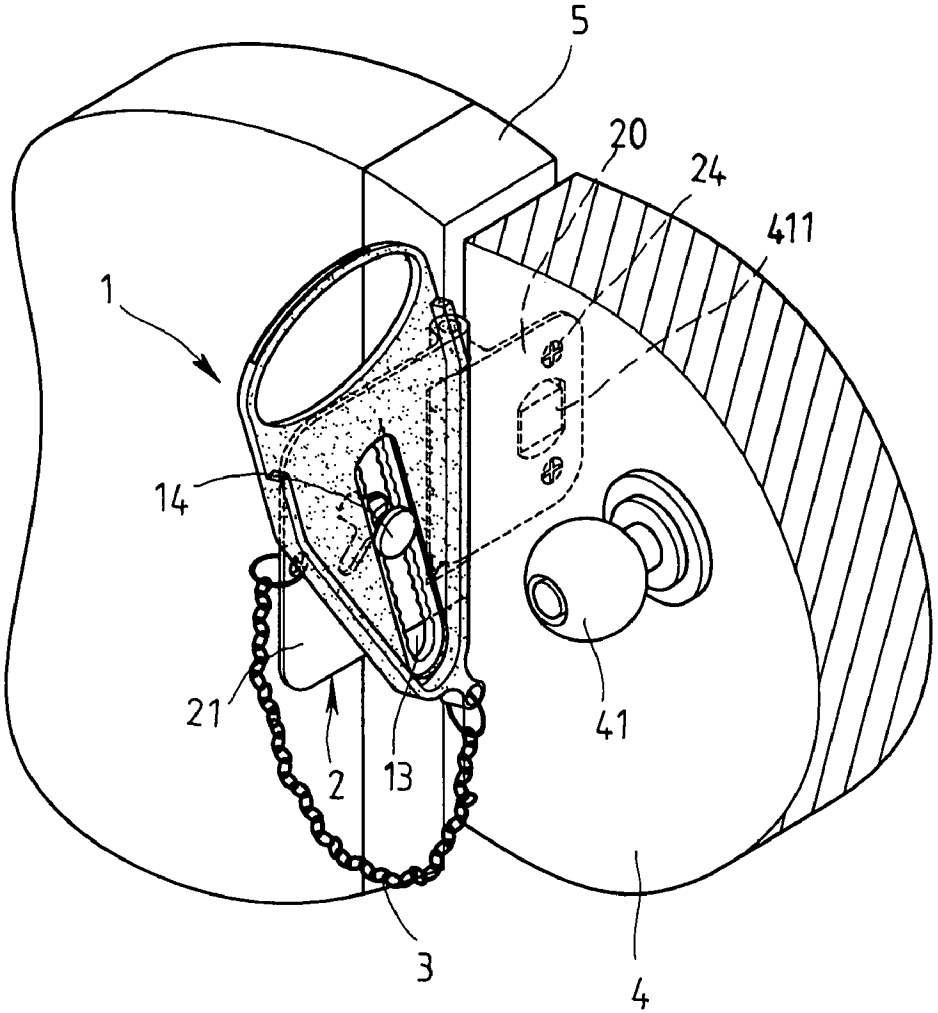
FIG. 5 is a perspective view to show the portable lock in FIG. 3 used for lock a door.
Figure 6A:
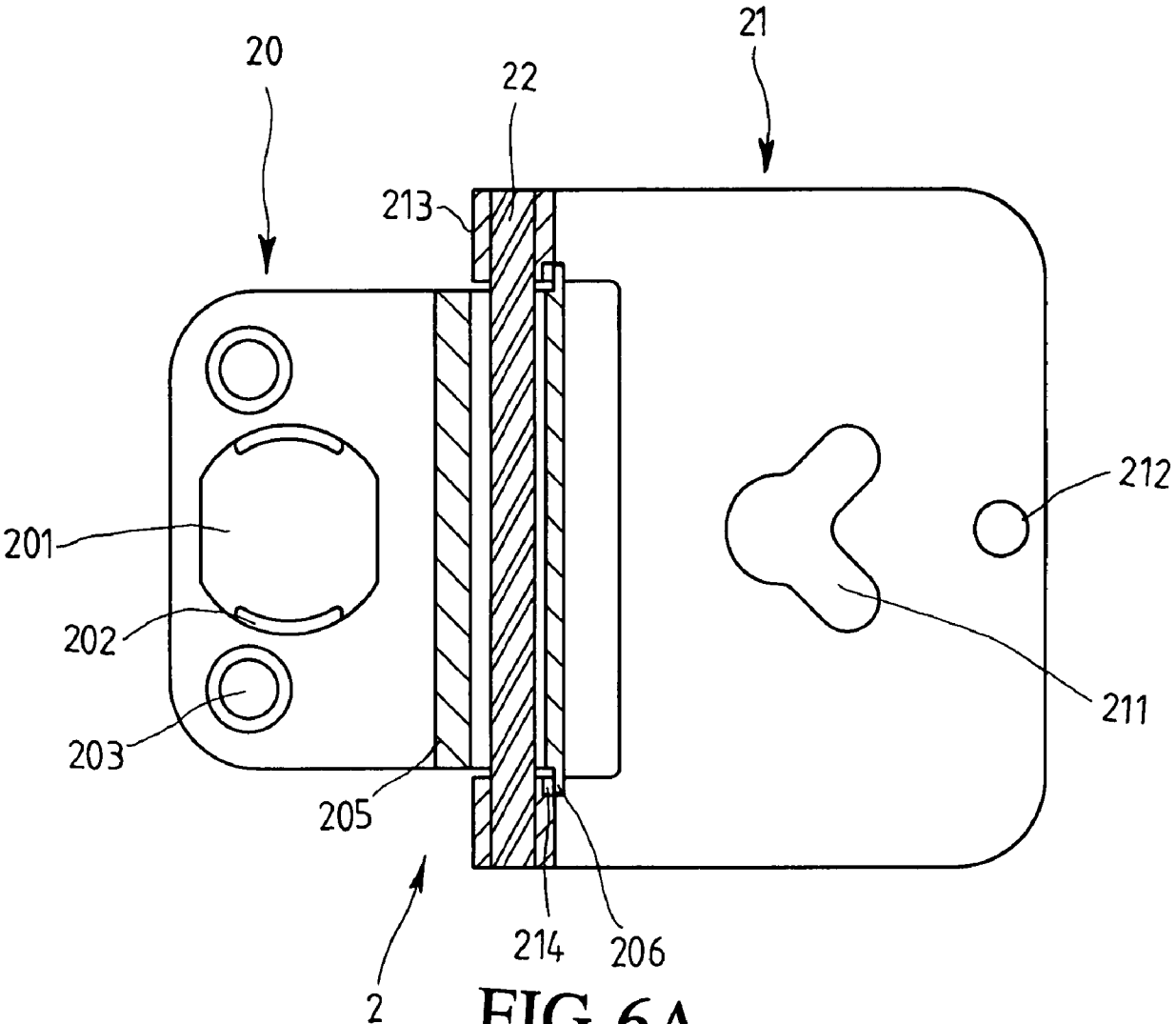
FIG. 6A shows the two projections on the protrusion of the second part are not yet shifted to be engaged with notches in the two lugs of the first part.
Figure 6B:
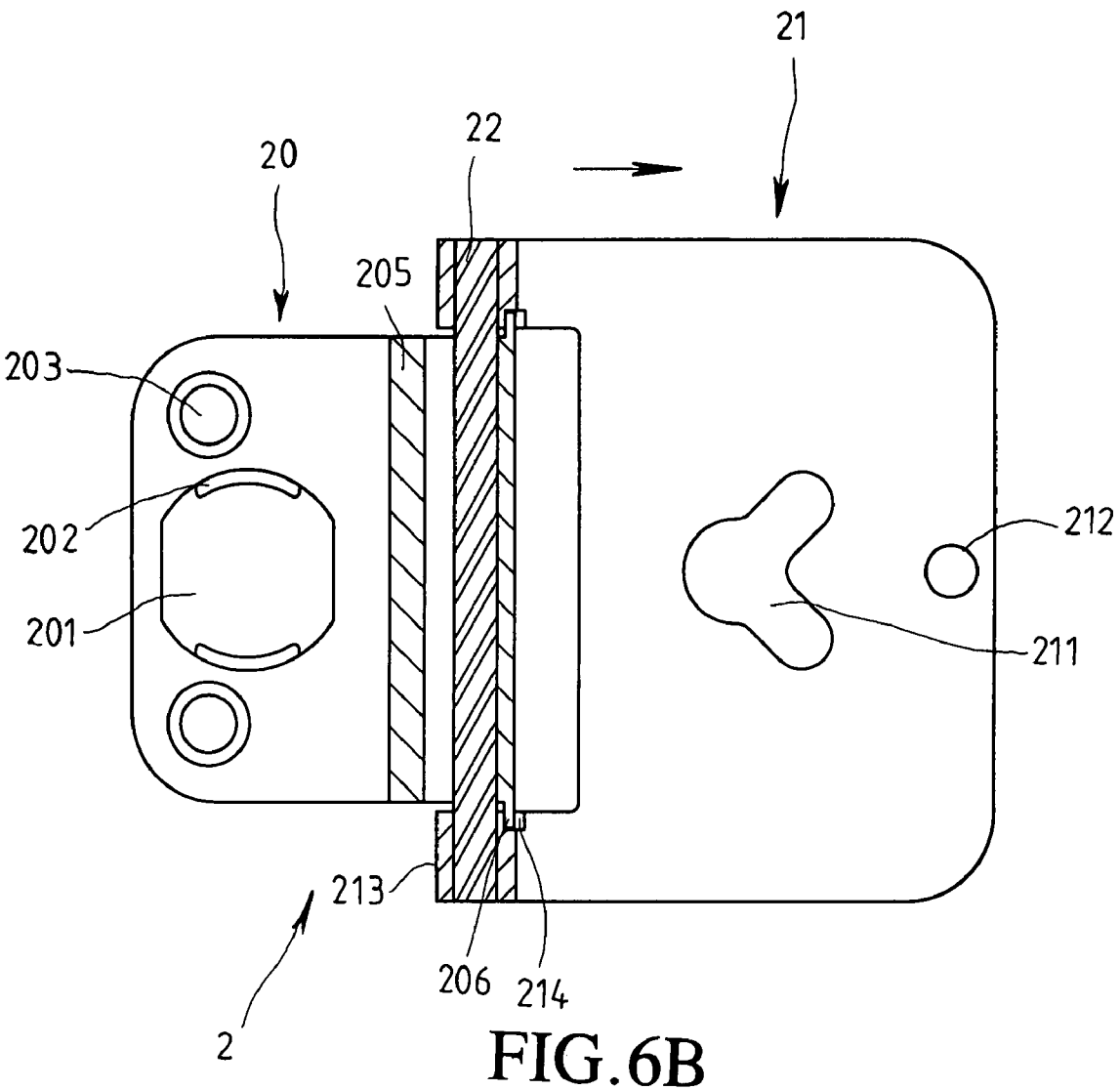
FIG. 6B shows the two projections on the protrusion of the second part are shifted to be engaged with notches in the two lugs of the first part.
Figure 6C:
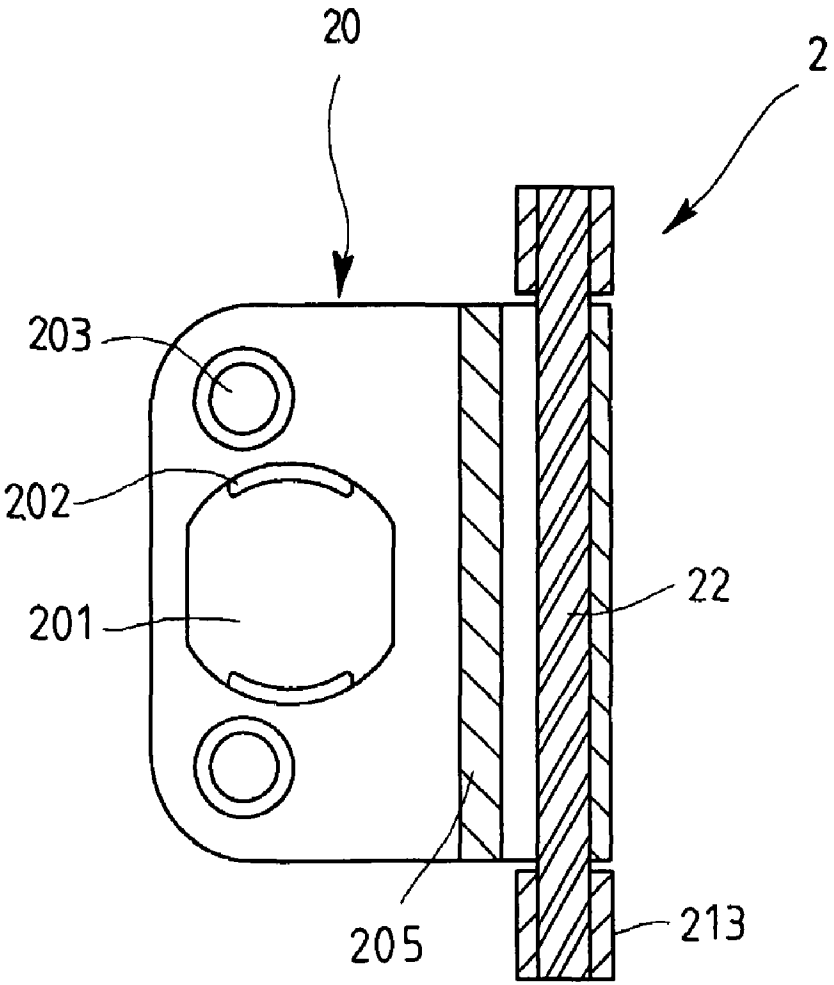
FIG. 6C shows the second part is pivoted about the pin.

When in use, after the door is closed, the other groove 141 of the rod 14 is engaged with an inner periphery of either one of the four engaging holes 211 in the connection plate 2. One of the flat sides of the flanges 12 is matched with an inside of the door as shown in FIG. 5, so that the door cannot be opened completely by the engagement of the rod 14 and the engaging hole 211. Therefore, the user needs not to install the portable door lock every time when closing the door.

Figure 2:
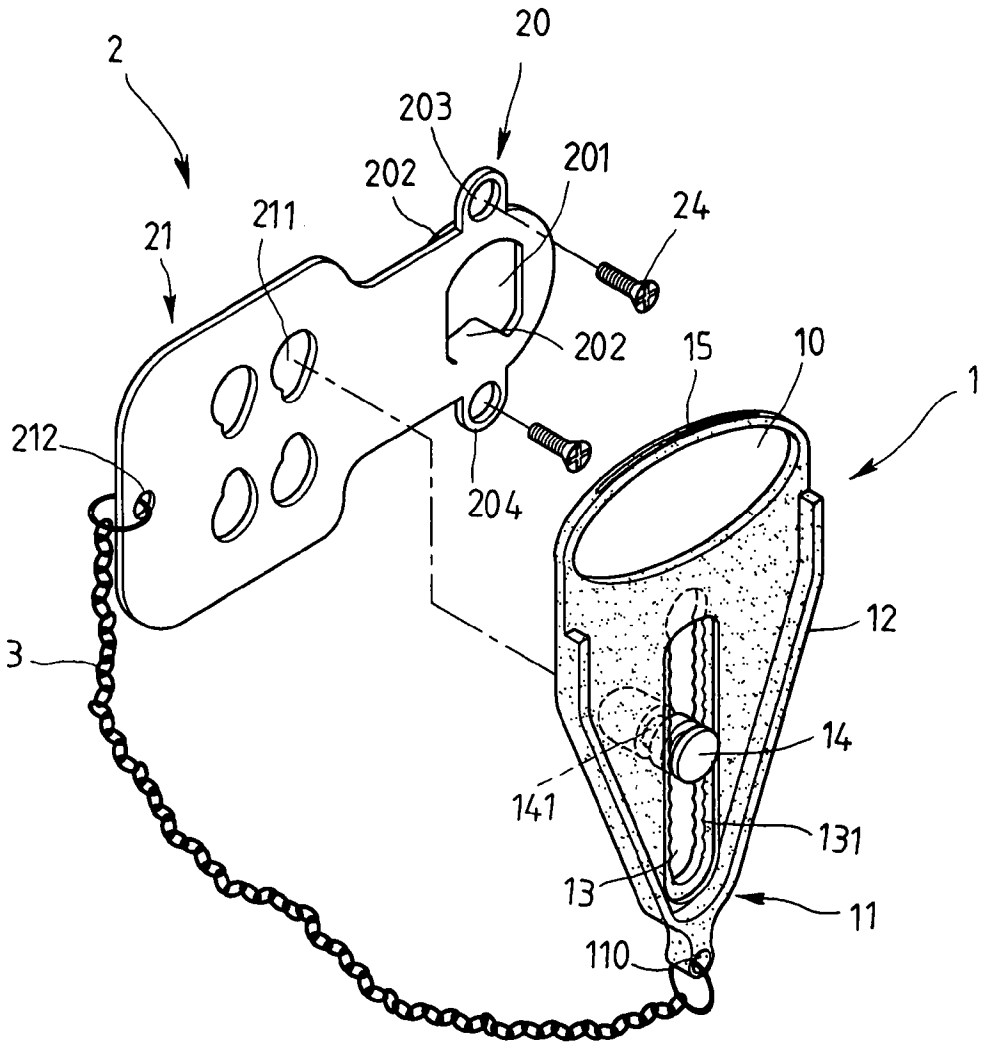
FIG. 2 is an exploded view to show another embodiment of the portable lock of the present invention.

FIG. 2 shows another embodiment of the connection plate 2, wherein the first end 20 of the connection plate 2 may have two rings 204 on two sides thereof and each ring has a positioning hole 203.

Figure 3:
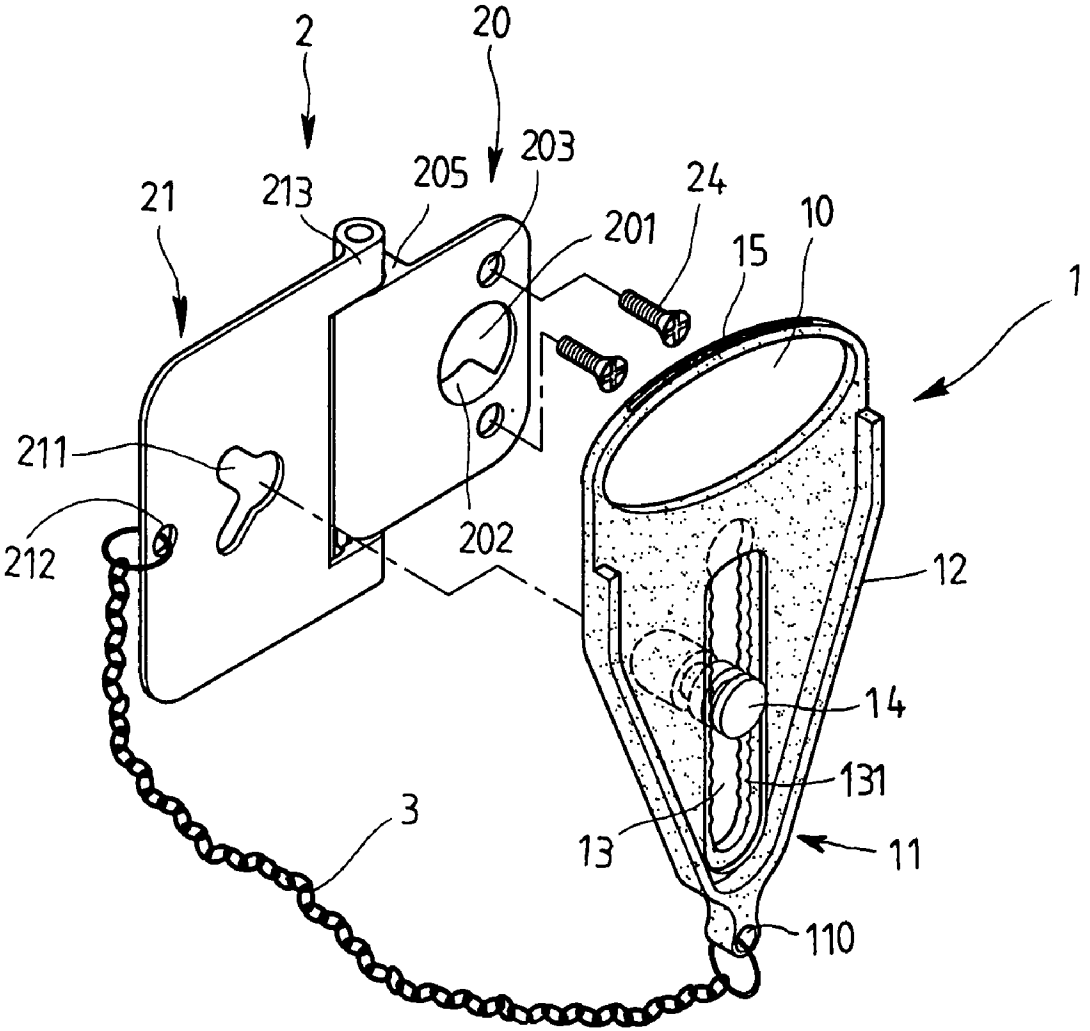
FIG. 3 is an exploded view to show yet another embodiment of the portable lock of the present invention.
Figure 4:
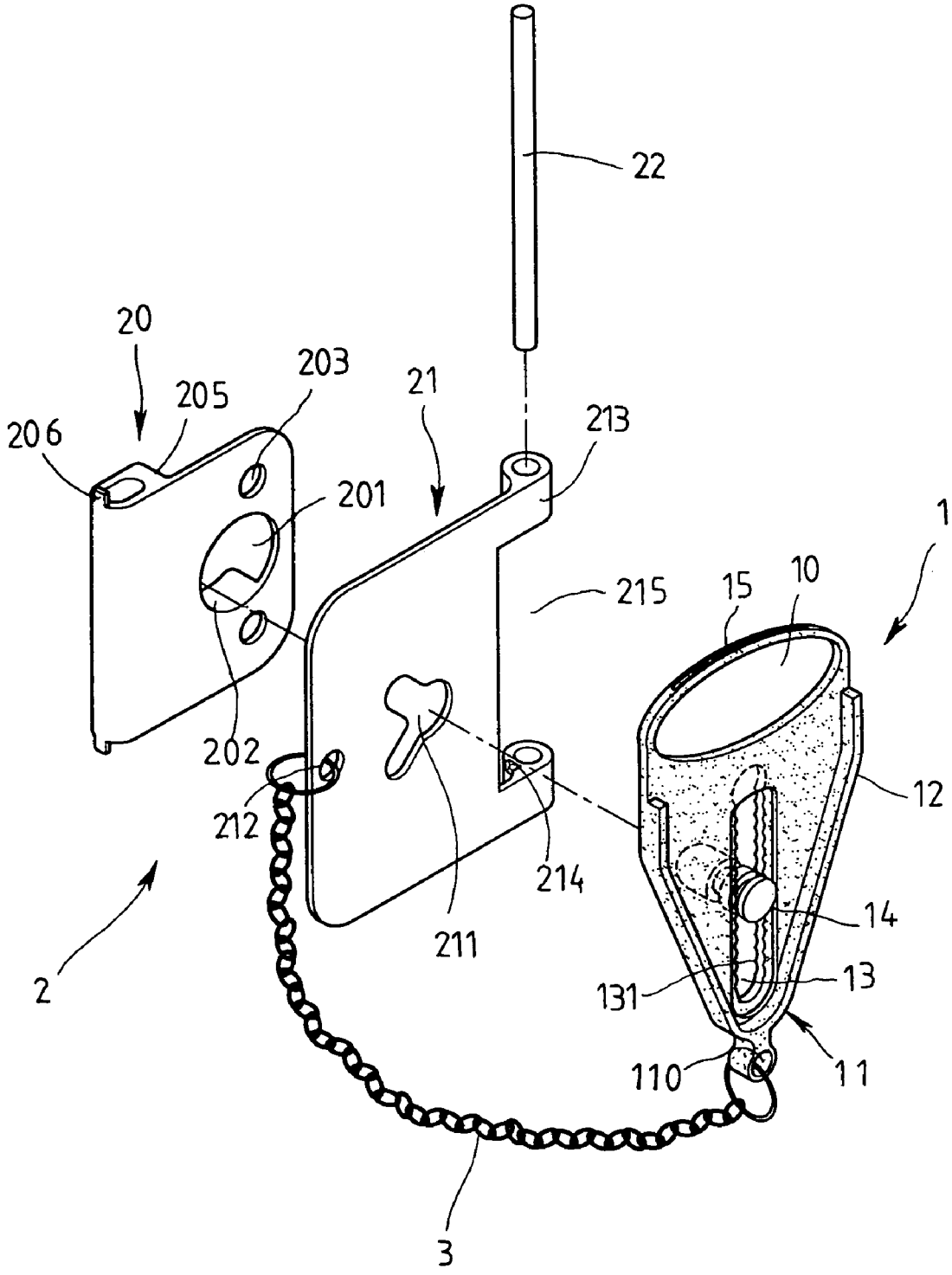
FIG. 4 is a further exploded view to show the portable lock in FIG. 3.

Referring to FIGS. 3 and 4, yet another embodiment of the present invention includes a stop member 1 and a connection plate 2, wherein the stop member 1 has the same characteristics as described regarding to FIGS. 1 and 2, so that detailed description is omitted, except for that a fluorescent mark 15 is painted on an outer surface of the periphery defining the holding hole 10 of the stop member 1 so that the user can see where the stop member 1 is during dark room.

The connection plate 2 is composed of a first part 20 and a second part 21. A hole 201 is defined through the first part 21 and two tongues 202 split from the hole 201 so as to be inserted in a recess in a door jamb 5 as disclosed in FIG. 5. When the door 4 is closed, the latch bolt 24 of the door lock assembly 41 is inserted in the hole 201 and the recess in the door jamb 5 so that the door 4 can only be opened by unlocking the door lock assembly 41. A protrusion 205 extends from a back side of the first part 20 and a passage is defined through the protrusion 205. The passage has an elongated inner periphery. Two positioning holes 203 are defined through the first part 20 and two bolts 24 extend through the two positioning holes 203 to fix the first part 20 of the connection plate 2 to the door jamb 5. Two engaging projections 206 extend from two ends of the protrusion 205.

The second part 21 has a Y-shaped engaging hole 211 defined therethrough and two lugs 213 extend from an end of the second part 21. Each lug 213 has a through hole and the protrusion 205 is located in a space 215 between the two lugs 213 and a pin 22 extends through the two lugs 213 and the passage in the protrusion 205, such that the second part 21 is able to be pivoted about the pin 22. A chain 3 is connected between the connection hole 110 of the stop member 1 and another connection hole 212 defined in the second part 21 of the connection plate 2. Two notches 214 are defined in an outer periphery of the two lugs 213 respectively, so that the two projections 206 can be shifted to be engaged with the two notches 214 by pulling the second part 21 in a direction away from the first part 20.

Figure 7A:
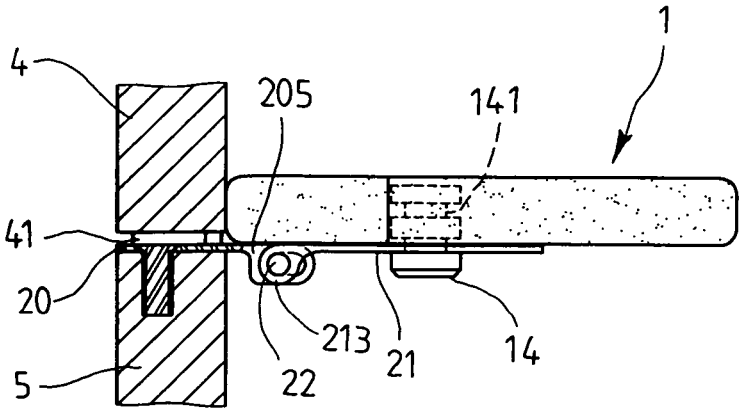
FIG. 7A is a top view of the status shown in FIG. 6A.
Figure 7B:
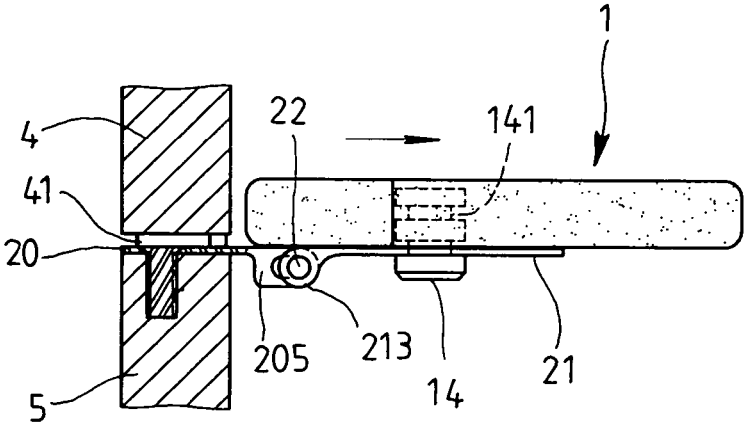
FIG. 7B is a top view of the status shown in FIG. 6B.
Figure 7C:
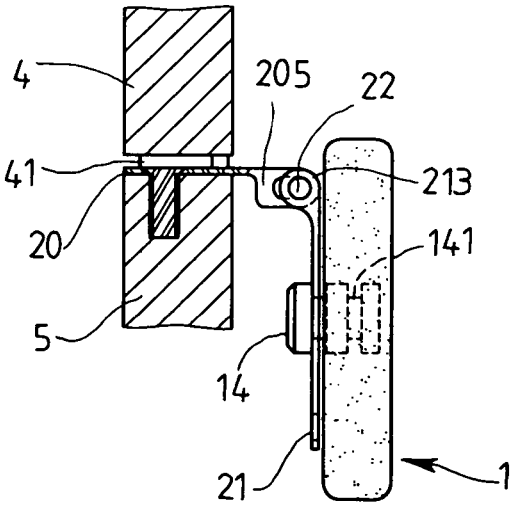
FIG. 7C is a top view of the status shown in FIG. 6C.
Figure 8:
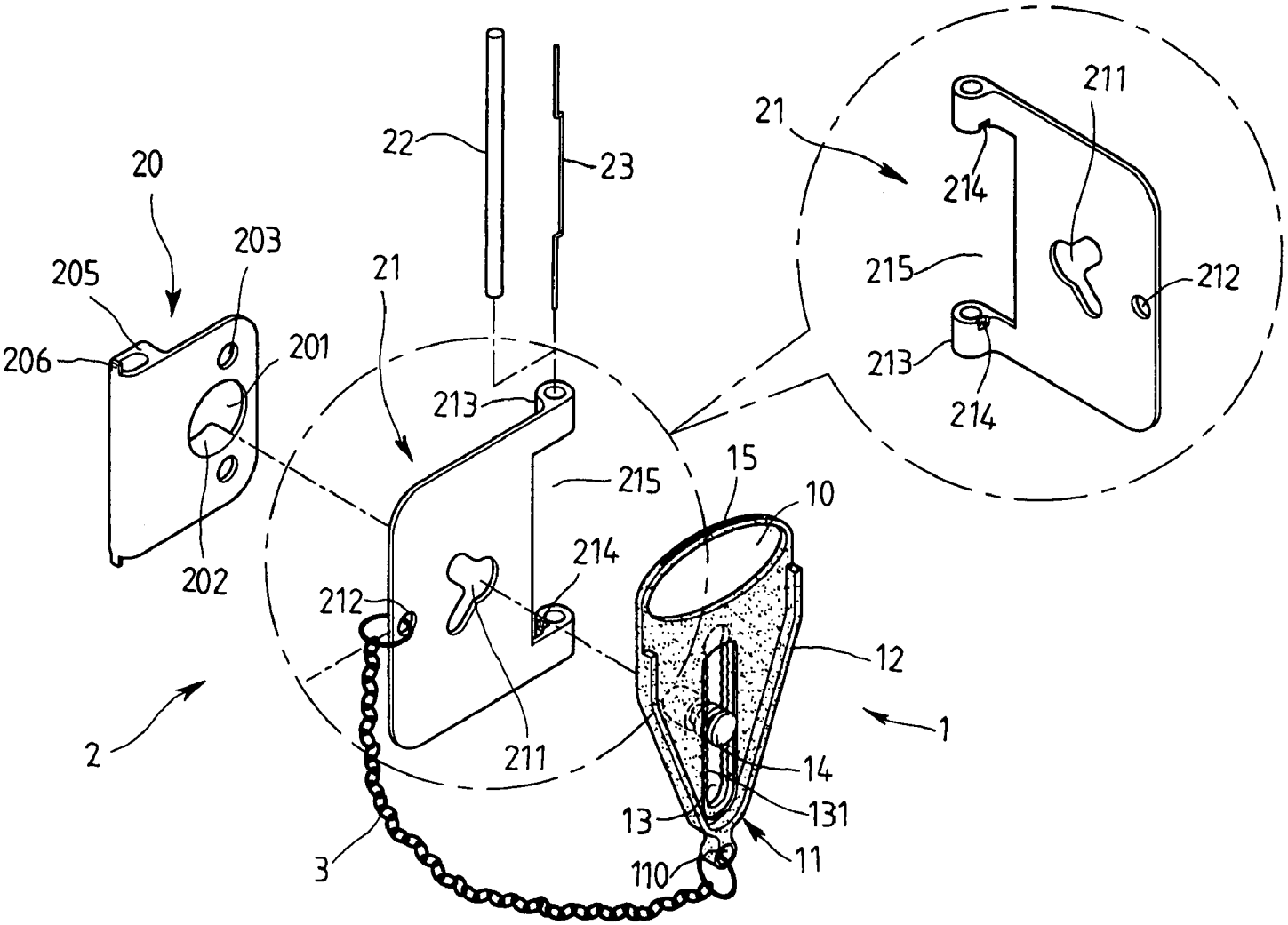
FIG. 8 shows a biasing member is received in the passage of the protrusion.
Figure 9A:
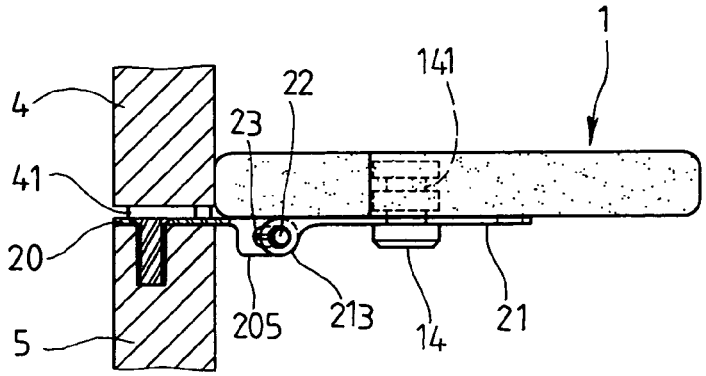
FIGS. 9A, 9B and 9C show the three statuses similar those shown in FIGS. 7A, 7B and 7C, of the embodiment as shown in FIG. 8.
Figure 9B:
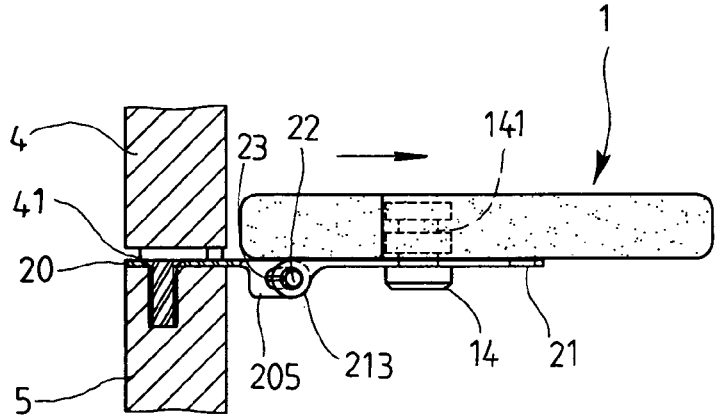
Figure 9C:
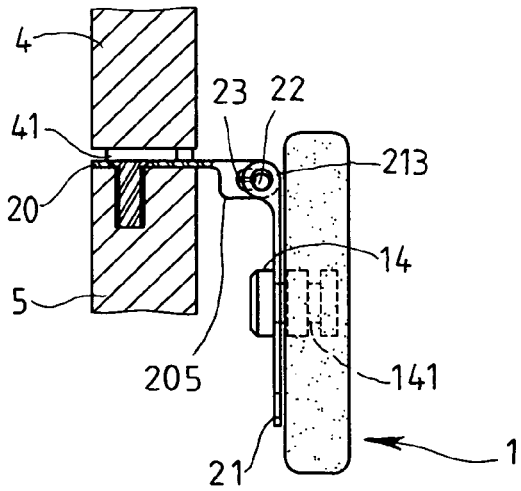
Figure 10:
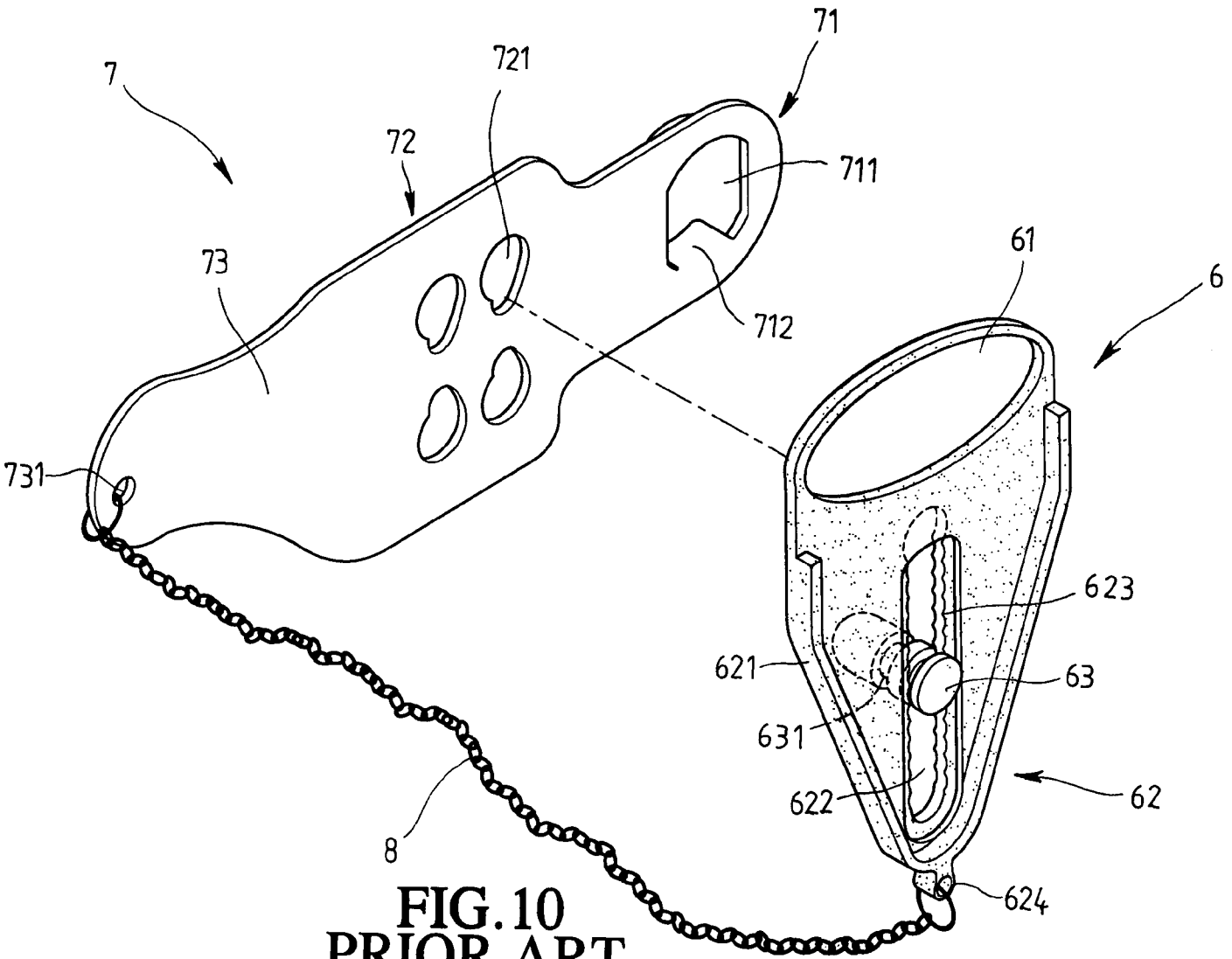
FIG. 10 PRIOR ART
FIG. 10 shows a conventional portable door lock.

Referring to FIGS. 6A, 6B, 6C, 7A, 7B and 7C, when in use, the rod 14 having two grooves 141 defined in an outer periphery thereof is inserted in the Y-shaped engaging hole 211 with one groove of the rod 14 engaged with the serrated insides of the slot 13 in the stop member 1 and the other groove in the rod 14 being engaged with the inner periphery of the engaging hole 211. One of the two flat sides of the flanges 12 is matched with the inside of the door 4 as shown in FIG. 5. When the door 4 is opened or the door lock is not used, the user may simply pull the second part 21 slightly away from the first part 20 to engage the two projections 206 with the notches 214, then the second part 21 can be pivoted 90 degrees as shown in FIG. 7C. This pivoted position of the second part 21 allows the second part 21 to be parallel to the wall so that the user will not be tangled or even hurt by the second part 21.

FIGS. 8, 9A, 9B and 9C show yet another embodiment of the portable door lock and this embodiment includes the same characteristics of the door lock described regarding to FIGS. 3 and 4, except for a biasing member 23 which is received in the passage of the protrusion 205 so as to bias the pin 22 to normally engaging the two projections 206 with the two notches 214.

While we have shown and described the embodiment in accordance with the present invention, it should be clear to those skilled in the art that further embodiments may be made without departing from the scope of the present invention.

What is claimed is:

1. A portable door lock comprising:

a stop member having a slot defined therethrough and a rod movably engaged with the slot, the stop member having a flat side which is adapted to contact an inside of a door;

a connection plate composed of a first part and a second part, a hole defined through the first part and a tongue split from the hole so as to be adapted to insert in a recess in a door jamb, a protrusion extending from a back side of the first part and a passage defined through the protrusion, two positioning holes defined through the first part and two bolts extending through the two positioning holes and adapted to be fixed to the door jamb, and the second part having at least one engaging hole defined therethrough and two lugs extending from an end of the second part, each lug having a through hole and the protrusion located between the two lugs and a pin extending through the two lugs and the passage in the protrusion.

2. The portable door lock as claimed in claim 1, wherein the slot includes two serrated insides and the rod includes two grooves defined in an outer periphery thereof, the serrated insides of the slot engaged with one of the two grooves and an inner periphery of the at least one engaging hole engaged with the other groove.

3. The portable door lock as claimed in claim 1, wherein two engaging projections extend from two ends of the protrusion and two notches are defined in an outer periphery of the two lugs respectively, the two projections being shifted to be engaged with the two notches by pulling the second part in a direction away from the first part.

4. The portable door lock as claimed in claim 1, wherein the at least one engaging hole is a Y-shaped hole.

5. The portable door lock as claimed in claim 3 further comprising a biasing member received in the passage of the protrusion and biases the pin to normally engaging the two projections with the two notches.

6. The portable door lock as claimed in claim 1 further comprising a fluorescent mark painted on an outer surface of the stop member.

7. The portable door lock as claimed in claim 1, the passage has an elongated inner periphery.

* * * * *